US005850949A

United States Patent [19]

Koerbel et al.

[11] Patent Number: 5,850,949

[45] Date of Patent: Dec. 22, 1998

[54] LIQUID CONTAINER APPARATUS HAVING A DRAIN CONDUIT SECURED TO A HANDLE

[76] Inventors: Claus E. Koerbel, 9750 N. 96th St., Apt. 161, Scottsdale, Ariz. 85258-5295; Carl E. Walker, 3047 S. 46th St., Phoenix, Ariz. 85044

[21] Appl. No.: 835,322

[22] Filed: Apr. 7, 1997

[51] Int. Cl.[6] ..... A47G 19/14

[52] U.S. Cl. ..... 222/475; 222/529; 222/530

[58] Field of Search ..... 222/475, 465.1, 222/528, 529, 530, 533

[56] References Cited

U.S. PATENT DOCUMENTS

| | | | |
|---|---|---|---|
| 48,664 | 7/1865 | Doty et al. | 222/530 |
| 1,315,724 | 9/1919 | Hipwell | 222/530 |
| 1,544,503 | 6/1925 | Thomson | 222/530 |
| 2,630,247 | 3/1953 | Rafferty | 222/530 |
| 4,416,396 | 11/1983 | Ward | 222/530 |
| 4,650,100 | 3/1987 | Echazabal, Jr. | 222/530 |
| 4,674,661 | 6/1987 | Herold | 222/528 |
| 5,472,124 | 12/1995 | Martushev | 222/530 |

FOREIGN PATENT DOCUMENTS

| | | | |
|---|---|---|---|
| 256812 | 3/1949 | Switzerland | 222/528 |
| 1250 | 4/1862 | United Kingdom | 222/530 |

*Primary Examiner*—Philippe Derakshani
*Attorney, Agent, or Firm*—H. Gordon Shields

[57] ABSTRACT

Container apparatus includes a container for a liquid and a hose or conduit connected to the bottom of the container through which liquid flows outwardly. The hose or conduit extends upwardly along the side of the container for storage purposes and is moved outwardly and downwardly to allow liquid to flow from the container through the hose or conduit. Different embodiments are illustrated, with the upper or discharge end of a hose or conduit secured to a breather spout for storage purposes and removed therefrom for draining the liquid from the container. The container apparatus includes a handle, and the handle includes a slot which receives the hose for storage purposes. The handle accordingly is disposed adjacent to the breather spout. Shutoff elements or valves are disclosed in two embodiments which serve as a double security for preventing the draining of the liquid inadvertently. The valve elements must be rotated away from their storage position in order to allow liquid to flow. Another embodiment discloses a container for holding a drinkable or potable liquid. The discharge conduit is secured to the container by a web and is closed by a cap. A convolution or pleated portion of the conduit above the connector web allows the outer or discharge end of the conduit to be maneuvered as desired by a user of the apparatus. The discharge end is closed by a cap.

8 Claims, 4 Drawing Sheets

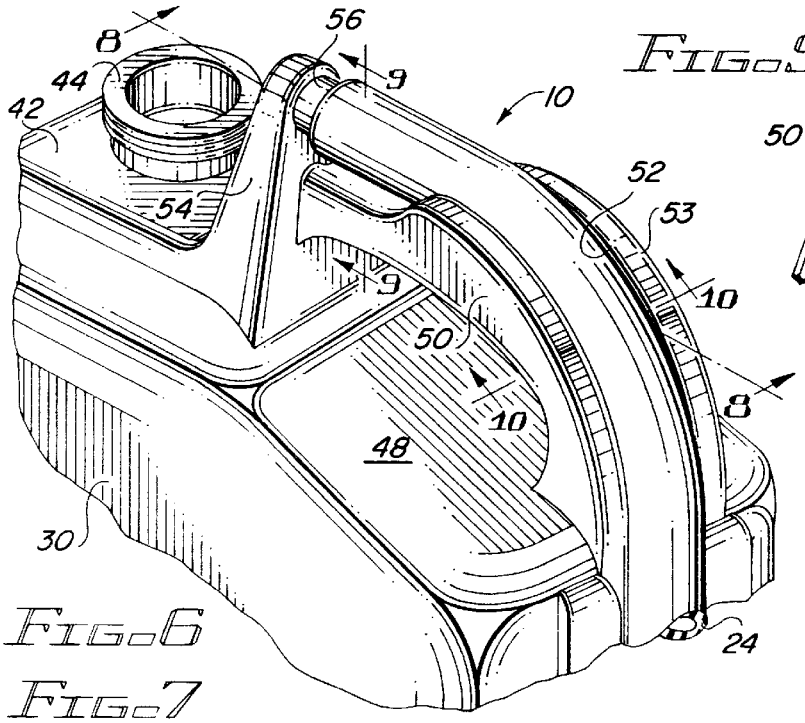
FIG. 6
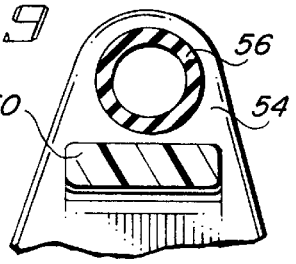
FIG. 9
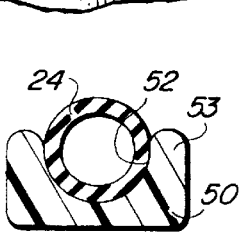
FIG. 10
FIG. 7
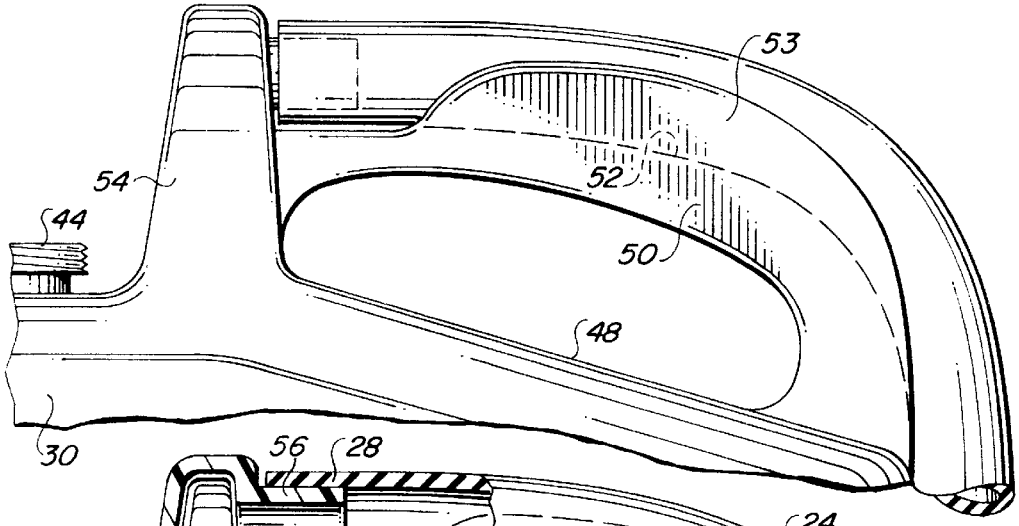
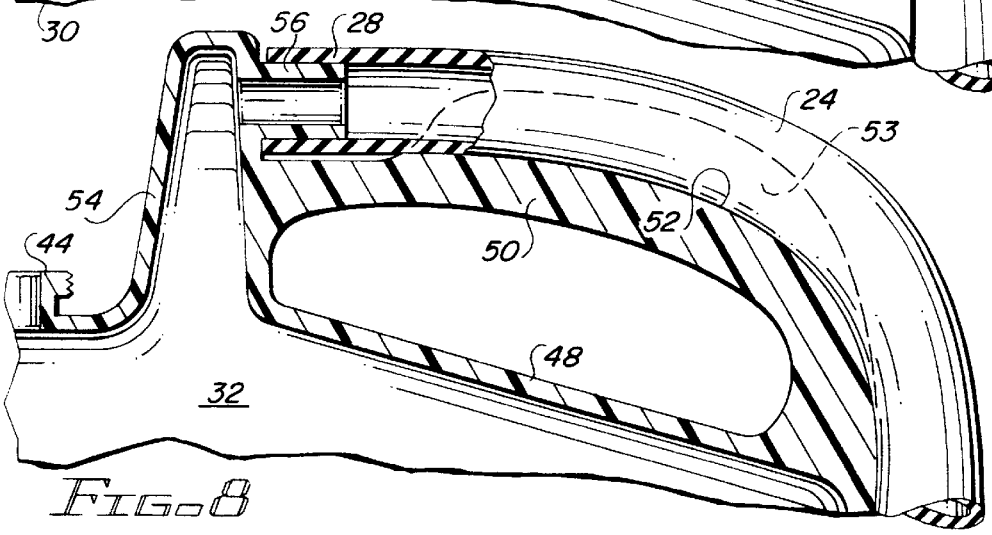
FIG. 8

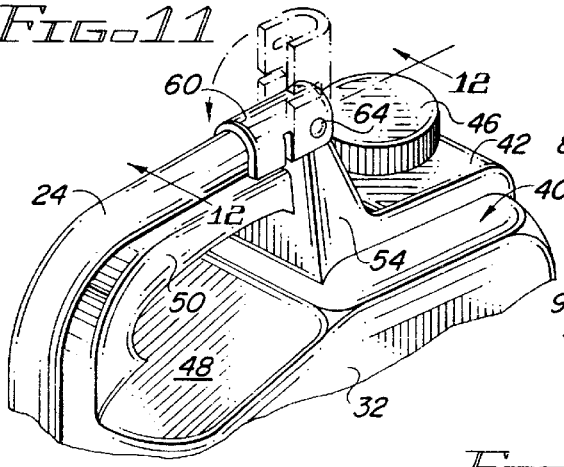
FIG. 11
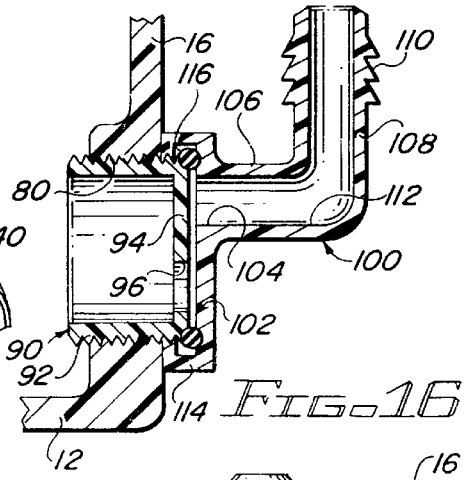
FIG. 16
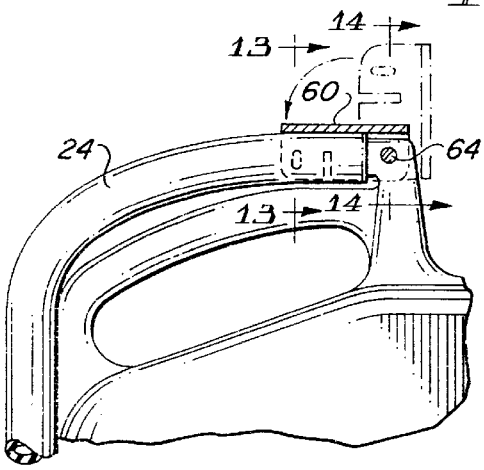
FIG. 12
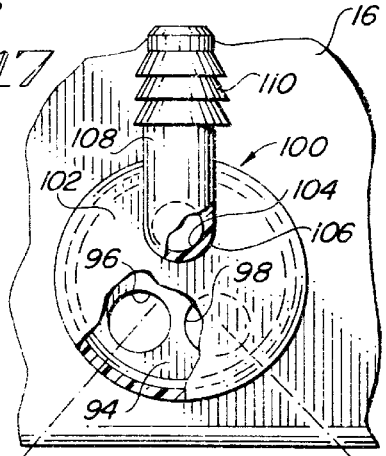
FIG. 17
FIG. 18
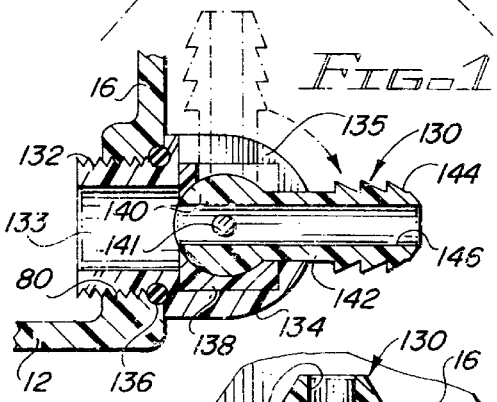
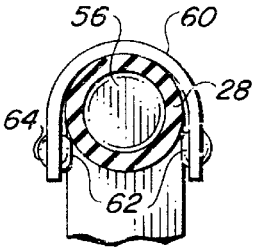
FIG. 13
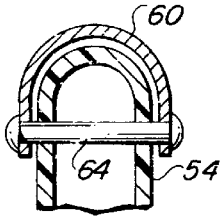
FIG. 14
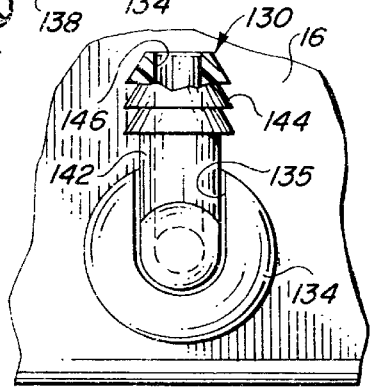
FIG. 19
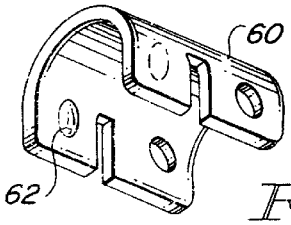
FIG. 15

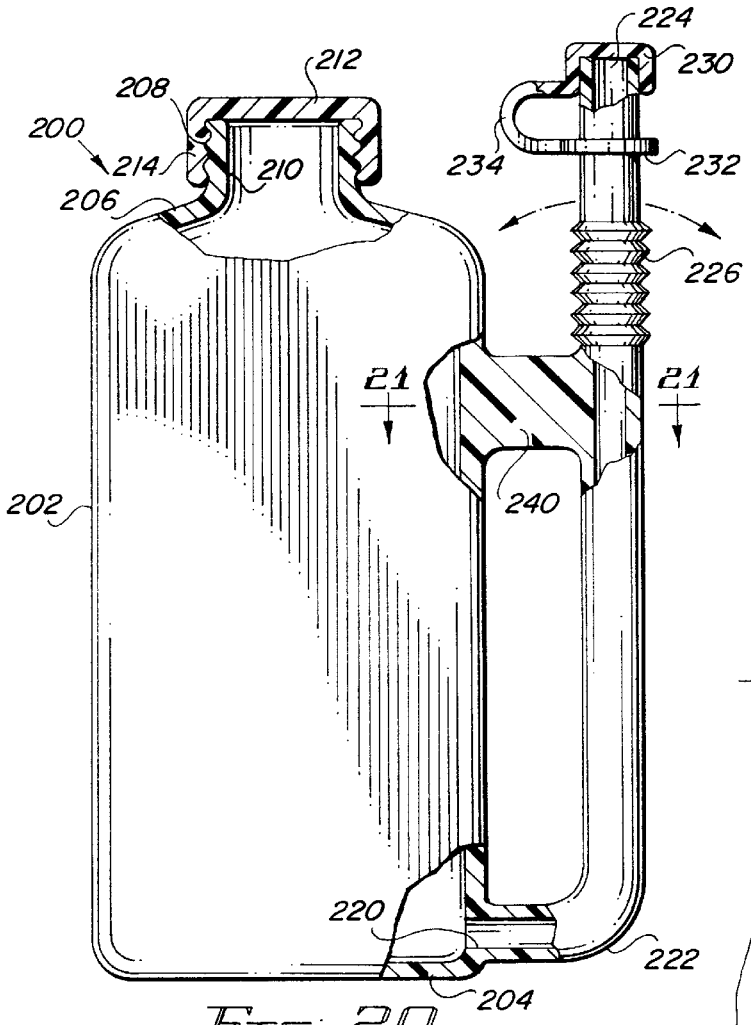
FIG. 20
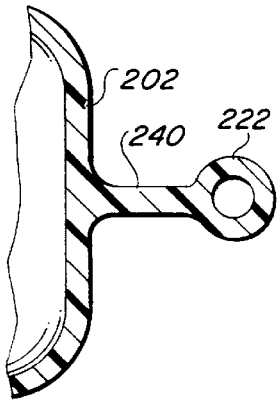
FIG. 21
FIG. 22
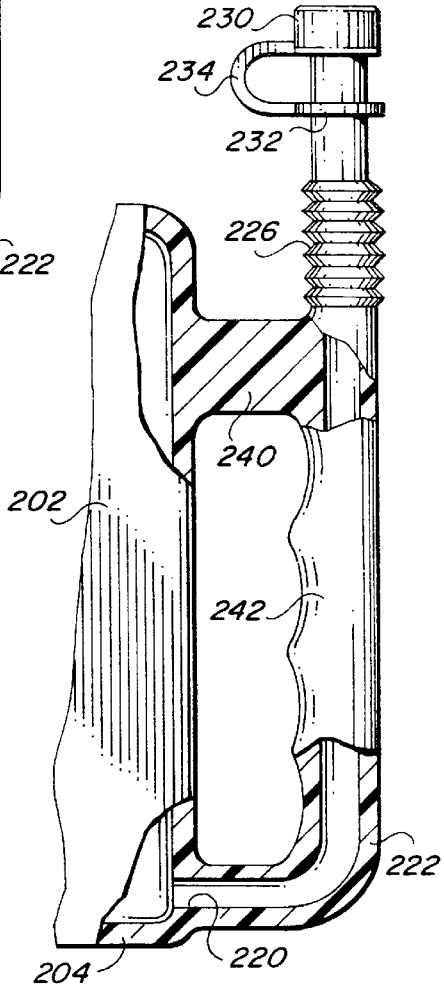
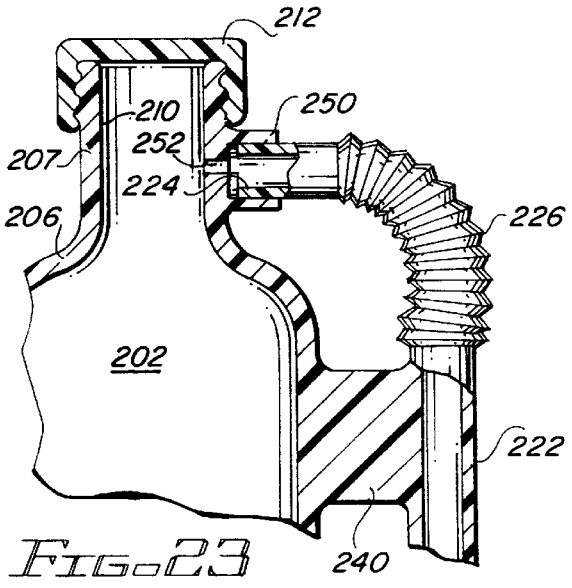
FIG. 23

LIQUID CONTAINER APPARATUS HAVING A DRAIN CONDUIT SECURED TO A HANDLE

BACKGROUND OF THE INVENTION

1. Field of the Invention

This invention relates to liquid containers and, more particularly, to containers having a discharge tube or conduit secured to the bottom of the container.

2. Description of the Prior Art

There are several types of liquid containers, and particularly fuel containers. Typically they are small, one gallon containers or relatively large, five gallon containers. The containers are generally sealed so that no fuel is lost by evaporation. For the large containers, there is typically a pouring spout as a separate unit but with threads that matingly engage an opening at the top of the container and which is usually covered by a lid or cover.

Smaller cans may also have a separate pouring or discharge spout or they may have a discharge spout combined with a lid and a disk which seals a lid and which must be removed in order to fit the spout onto the lid. Typically, the pour spouts extend into the container and are held in place by the lid when the container is sealed. When it is desired to pour fuel from the container, the lid is removed, the disk is removed from the interior of the lid, and the pouring spout is then secured to the lid and to the container.

Both types of fuel containers have obvious problems. The need for a separate conduit or spout is an obvious drawback, as is the need to remove the cap and secured the spout to the cap. With the cap inside the container, and accordingly emersed, at least partially, within the fuel, the user must deal with the inherent problems associated with handling the pour spout, etc.

The apparatus of the present invention utilizes a discharge tube which is permanently secured to the container but that is also secured to the container and to an air breather spout when the container is being stored. The conduit or hose is flexible, and is simply removed from the breather spout for use in draining the container. The conduit or hose is secured to the bottom of the container, rather than the top, as with the prior art, and accordingly the container need not be tipped in order to discharge the fuel. Rather, vertical movement of the container relative to the outer end of the discharge hose governs the flow of fuel out of the container.

SUMMARY OF THE INVENTION

The invention described and claimed herein comprises a container having a fill spout and a breather spout extending outwardly from a boss adjacent to the fill spout. A flexible conduit or discharge hose is connected to the bottom of the container and is disposed against a handle at the top of the container and connected to the breather spout when the container is being stored. For use, the discharge hose is removed from the breather spout and the container is moved vertically relative to the free end of the discharge spout in order to control the flow from the container. An alternate embodiment for a hand held liquid container for drinking purposes eliminates the breather spout.

Among the objects of the present invention are the following:

To provide a new and useful container for liquid;

To provide a new and useful container having a bottom discharge;

To provide new and useful container apparatus having a flexible conduit secured to the bottom of a container and connected to the upper portion of the container for storage of the container; and To provide new and useful container for fuel having a slotted handle in which a portion of a discharge conduit is disposed for storage purposes.

BRIEF DESCRIPTION OF THE DRAWING

FIG. 6 is a perspective view of an alternate embodiment of the apparatus of FIG. 1.

FIG. 7 is a side view of the apparatus of FIG. 6.

FIG. 8 is a view in partial section taken generally along line 8—8 of FIG. 6.

FIG. 9 is a view in partial section taken generally along line 9—9 of FIG. 6.

FIG. 10 is a view in partial section taken generally along line 10—10 of FIG. 6.

FIG. 11 is a perspective view of another alternate embodiment of the apparatus of the present invention.

FIG. 12 is a view in partial section taken generally along line 12—12 of FIG. 11.

FIG. 13 is a view in partial section taken generally along line 13—13 of FIG. 12.

FIG. 14 is a view in partial section taken generally along line 14—14 of FIG. 12.

FIG. 15 is a perspective view of a portion of the apparatus of FIG. 11.

FIG. 16 is a side view in partial section of another alternate embodiment of the apparatus of the present invention.

FIG. 17 is an end view of the apparatus of FIG. 16.

FIG. 18 is a view in partial section of another alternate embodiment of the apparatus of the present invention.

FIG. 19 is an end view of the apparatus of FIG. 18.

FIG. 20 is a side view of another alternate embodiment of the present invention.

FIG. 21 is a view in partial section taken along line 21—21 of FIG. 20.

FIG. 22 is a fragmentary side view in partial section of an alternate embodiment of the apparatus of FIG. 20.

FIG. 23 is a fragmentary side view of another alternate embodiment of the apparatus of FIG. 20.

DESCRIPTION OF THE PREFERRED EMBODIMENT

Figure 1:
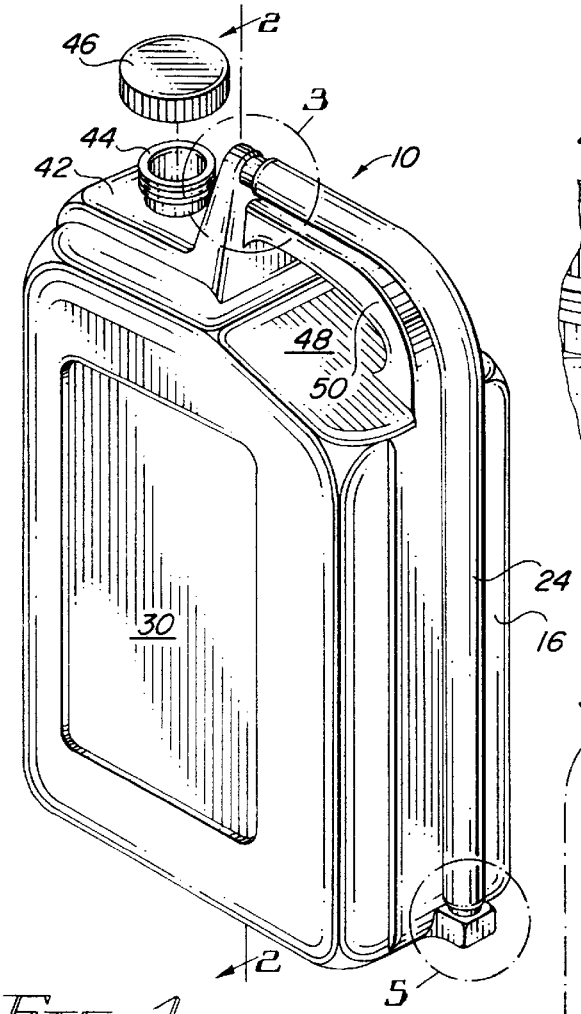
FIG. 1 is a perspective view of the apparatus of the present invention.
Figure 2:
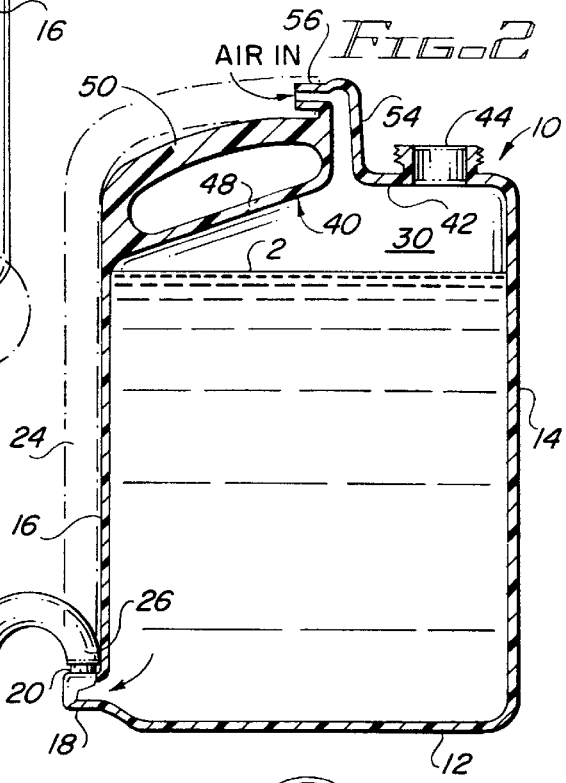
FIG. 2 is a view in partial section taken generally along line 2—2 of FIG. 1.

FIG. 1 is a perspective view of container apparatus 10 of the present invention. FIG. 2 is a view in partial section of the can apparatus 10 of FIG. 1, taken generally along line 2—2 of FIG. 1. For the following discussion, reference will primarily be made to FIGS. 1 and 2.

The container apparatus 10 includes a bottom 12, a front wall 14, a rear wall 16, a pair of side walls, of which a side wall 30 is shown in FIGS. 1 and 2, and a side wall 32 which is shown in FIG. 8. The container also includes a top wall 40.

The top 40 includes several different portions, including a generally flat portion 42 adjacent to the front wall 14, and a fill spout 44 extends upwardly from the front flat portion 42. The fill spout 44 is closed by a cap 46. The cap 46 is shown spaced apart from the spout 44 in FIG. 1.

The top wall 40 also includes a rear sloping portion 48 which extends upwardly from the rear wall 16. A handle 50 extends upwardly from the rear sloping portion adjacent to the rear wall 16 and extends to a top boss 54. The boss 54 extends upwardly from the juncture of the front portion 42 and the sloping portion 48.

A breather spout 56 extends rearwardly from the top of the boss 54. The boss 54 is, of course, in communication with the interior of the container and air flows inwardly through the spout 56 as the liquid contents of the container apparatus 10 are discharged or flow outwardly through the hose 24. In FIG. 1, the hose 24 is shown connected to the breather spout 56. This comprises the storage configuration of the apparatus 10. In FIG. 2, the discharge hose 24 is shown removed from the spout 56 and extending downwardly to allow the contents of the container 10 to flow outwardly. Also shown in FIG. 2 in dash dot line is the hose 24 connected to the spout 56.

Within the can apparatus 10 is a liquid 2, shown in FIG. 2. The liquid 2, in the primary use adaptation of the apparatus 10, is a fuel, such as gasoline. However, it is obvious that the container apparatus 10 is suitable for various kinds of liquids in addition to a fuel such as gasoline.

Figure 3:
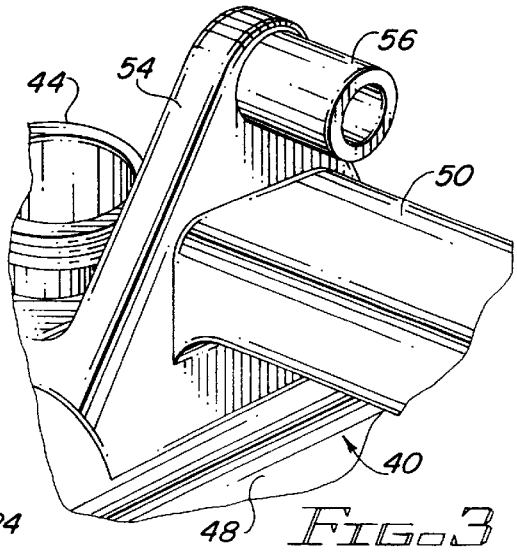
FIG. 3 is an enlarged view in partial section of a portion of the apparatus of FIG. 1 taken generally from circle 3 of FIG. 1.
Figure 4:
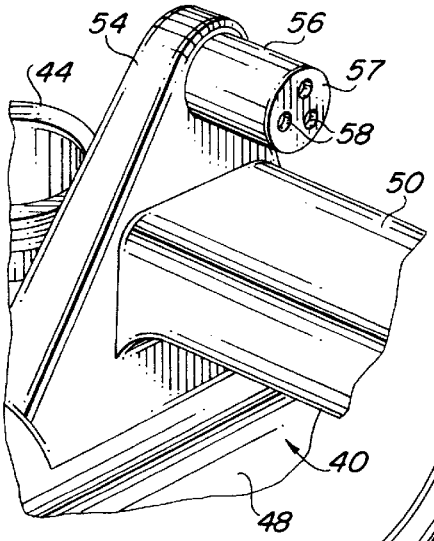
FIG. 4 is an enlarged perspective view of a portion of the apparatus of the present invention.

Two different configurations of the spout 56 are shown in FIGS. 3 and 4. FIGS. 3 and 4 are substantially identical perspective views, with FIG. 3 comprising the embodiment illustrated in FIGS. 1 and 2, and FIG. 4 comprising an alternate embodiment of the apparatus shown best in FIG. 3. In FIG. 3, which is taken generally from circle 3 of FIG. 1, the spout 56 is shown substantially the same as in FIG. 2, in which the breather spout 56 is open, thus allowing air to flow inwardly through the spout 56 and into the interior of the container apparatus 10.

In FIG. 4, the spout 56 is closed by an end wall 57, thus sealing the spout 56.

If desired, an aperture or apertures, such as illustrated in FIG. 4 as apertures 58, may extend through the end wall 57, thus providing a degree of protection from dust and dirt, but still allowing air to flow into the container 10 as the liquid is drained through the hose 24.

Figure 5:
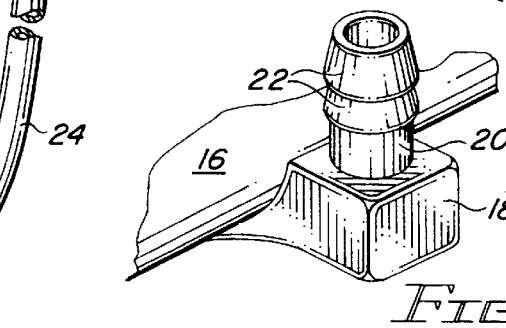
FIG. 5 is an enlarged perspective view of a portion of the apparatus of FIG. 1 taken generally from circle 5 of FIG. 1.

FIG. 5 is a perspective view of the discharge boss 18 and the discharge tube 20. FIG. 5 is taken generally from circle 5 of FIG. 1.

A discharge boss 18 extends outwardly from the rear wall 16 adjacent to the bottom wall 12. A discharge tube 20 extends upwardly from the boss 18. A flexible discharge conduit or hose 24 is appropriately secured to the conduit 20. The flexible conduit or hose 24 includes a bottom end 26 which is secured to the discharge tube 20, and an outer or discharge end 28, remote from the bottom end 26. The outer end 26 is secured to the container when the container is in a storage position.

The boss 18 is shown in FIG. 5 extending outwardly from the back wall 16, with the conduit 20 extending upwardly therefrom. The conduit 20 is shown with a plurality of ribs 22. The ribs 22 help to secure the bottom end 26 of the conduit or hose 24 to the conduit 20.

FIG. 6 is a perspective view of the upper portion of the container 10, with an alternate configuration of the handle 50. FIG. 7 is a side view of the handle 50 of FIG. 6, and FIG. 8 is a view in partial section through the handle 50 taken generally along line 8—8 of FIG. 6.

FIGS. 9 and 10 are views in partial section taken generally along lines 9—9 and 10—10 of FIG. 6, respectively. For the following discussion, reference will primarily be made to FIGS. 6, 7, 8, 9, and 10.

The primary difference between the handle 50 of the embodiments of FIG. 1 and FIG. 6 is that the handle 50 of FIG. 6 includes a slot 52 in which is disposed the upper portion of the hose 24.

A pair of upwardly extending wall portions 53 define the slot 52. The sides 53 extend generally upwardly from the handle 50 at the slot 52 or to define the slot 52. As best shown in FIG. 10, the hose 24 extends into the slot 52 and nests conveniently therein. The side walls 53 help to insure that the hose 24 is not inadvertently knocked away from the breather spout 56.

The handle 50 extends to the top boss 54 below the breather spout 56 a distance sufficient to easily connect and disconnect the top portion or outer end of the conduit or hose 24.

FIGS. 11, 12, 13, 14, and 15 disclose a clamp arrangement for securing the hose 24 to the breather spout 56. FIG. 11 is a perspective view of the upper portion of the top wall 40, its front flat portion 42, the boss 54, cap 46, handle 50, and conduit or hose 24 with a clamp 60 secured to the boss 54 adjacent to the spout 56. FIG. 12 is a side view in partial section illustrating the clamp 60, and FIGS. 13 and 14 are views in partial section taken along lines 13—13 and 14—14 of FIG. 12. FIG. 15 is a perspective view of the clamp 60. For the following discussion, reference will primarily be made to FIGS. 11, 12, 13, 14, and 15.

The clamp 60 is a generally U-shaped element, elongated and pinned to the boss 54 adjacent to the spout 56. The "rear" portion of the clamp 60 includes a pair of aligned apertures through which a pin 64 extends to secure the clamp 60 to the boss 54. The "front" portion of the clamp 60 fits over the hose 24 to secure the hose 24 to the spout 56. The clamp 60 pivots on the pin 64 downwardly to secure the clamp over the hose 24 and upwardly to allow the hose 24 to be removed from the breather spout 56.

The "front" portion of the clamp 60 includes a pair of bumps 62 which frictionally engage the outer end 28 of the hose 24 to help secure the clamp 60 onto the outer end 28 of the hose or conduit 20.

FIGS. 16 and 17 disclose alternate structure to which the hose or conduit 24 may be secured. FIG. 16 is a view in partial section at the juncture of the bottom 12 and the rear wall 16, showing a discharge cap 100 secured to a spout 90. FIG. 17 is a front view of the spout 100 and the wall 16. For the following discussion, reference will primarily be made to FIGS. 16 and 17.

A threaded aperture 80 extends through a thickened portion of the back wall 16 adjacent to the bottom 12. Extending through the threaded aperture 80 is a spout 90. The spout 90 includes an exteriorly threaded cylindrical portion 92 which matingly engages the threaded aperture 80. The spout 90 also includes an end wall 94 through which extends a pair of apertures 96 and 98.

The discharge cap 100 is secured to the spout 90. The discharge cap 100 includes an end wall 102 through which extends an aperture 104. The aperture 104 is disposed within an outwardly extending conduit 106. The conduit 106 includes a vertical portion 108 which includes a plurality of outwardly extending ribs 110. The ribs 110 are substantially identical to the ribs 22, best illustrated in FIG. 5, and help to secure the bottom end 26 of the conduit or hose 24 to the discharge cap 100.

A bore 112 extends through the conduit 106 as a continuation of the aperture 104.

A flanged rim 114 extends from the end wall 102 to engage a portion of the threads of the externally threaded portion 92 to secure the discharge cap 100 to the spout 90. An O-ring 116 is used to seal the spout 90 and the discharge cap 100 together.

The discharge cap 100 is rotatable on the spout 90 to align the aperture 104 with the apertures 96 and 98 to allow flow of the liquid from within the container 10 outwardly through aperture 104, the bore 112, and the hose or conduit 20. When the discharge cap 100 is oriented as illustrated in FIGS. 16 and 17, the aperture 104 is not aligned with the apertures 96 and 98, and accordingly no liquid will flow from the container through the apertures 96 and 98 and 104. Accordingly, the discharge cap 100 essentially is in an "off" position. The "on" position of the discharge cap 100 is illustrated by the dash dot lines in FIG. 17 whereby the vertical conduit portion 108 is pivoted away from the vertical about 135 degrees in either direction.

FIGS. 18 and 19 illustrate still another type of on-off structure for allowing fluid flow from the container 10. FIG. 18 comprises a view in partial section through the rear wall 16 at its juncture with the bottom 12 illustrating a discharge spout 130 secured to the threaded aperture 80, and FIG. 19 is a front view of the discharge spout 130 at the wall 16. For the following discussion, reference will primarily be made to FIGS. 18 and 19.

The discharge spout 130 includes an exteriorly threaded cylindrical portion 132 which matingly engages the threaded aperture 80. An outer cap 134 is secured to the portion 132. The outer cap 134 includes a slot 135 in which is pivoted a ball 140. A conduit 142 is secured to the ball 140. The ball is secured to the cap 134 by means of a pin 141. The ball 140 is disposed within an insert 138 and moves therein. The insert 138 is disposed in the slot 135 in the cap 134.

On the outside of the conduit 142 are ribs 144. The ribs 144 are substantially identical to the ribs 110 and the ribs 22, for securing the bottom end 26 of the conduit or hose 24 to the conduit 142. Extending through the conduit 142 in the ball 140 is a bore 146.

When the conduit 142 is disposed in the vertical position, as shown in FIG. 19, the inner portion of the bore 146 is disposed within the insert 138, and accordingly is not aligned with the bore 133 of the spout 130. Accordingly, no fluid will flow from the container 10 through the discharge spout 130 and the hose 24. However, when the conduit 142 is pivoted on the pin 141, to align the bore 146 with the bore 133, as shown in FIG. 18, then there will be a flow of the liquid from the container 10 outwardly through the bores 133 and 136, and the hose 24, etc.

In the embodiment of FIGS. 1–5, it is the position of the outer end 28 of the hose 24 which determines flow of the liquid from within the container apparatus 10 outwardly. In the embodiment of FIGS. 16 and 17, there is a rotational or pivoting action generally parallel to the back wall 16 which determines the flow of the liquid as well as the position of the outer end 28 of the hose 24. In the embodiment of FIGS. 18 and 19, there is a pivoting action generally perpendicular to the wall 16 as well as the position or location of the outer end 28 of the hose 24 relative to the container apparatus 10 which determines the flow of the liquid. Thus, the embodiments of FIGS. 16, 17, and 18, 19 provide a double safety feature or shutoff feature.

FIG. 20 comprises a side view of another alternate embodiment of the apparatus of the present invention. The embodiment illustrated in FIG. 20 comprises a container 200 which is a relatively smaller container holding a drinkable liquid. FIG. 21 is a view in partial section of a portion of the container 200 taken generally along line 21—21 of FIG. 20. For the following discussion, attention will be directed primarily to FIGS. 20 and 21.

The container apparatus 200 is contrasted with the generally larger container holding such a liquid as gasoline, or the like, as illustrated in FIGS. 1–19. The container apparatus 200 is designed to be held by a user's hand while drinking.

The container 200 includes a cylinder 202 closed by a bottom 204. At the upper portion of the cylinder 204 is an inwardly and upwardly tapering neck 206 which terminates in an upper threaded portion 208. Extending through the threaded portion 208 is a top opening 210. The top opening 210 is closed by a cap 212. The cap 212 includes a downwardly extending internally threaded flange 214 which matingly engages the threaded portion 208.

A bottom opening or aperture 220 extends through the wall 204 at the juncture with the bottom 204. A tube 22 is connected to the bottom opening 220 to allow liquid within the cylinder 202 to flow outwardly.

The tube 202 extends upwardly and terminates in an upper end 224. A cap 230 is disposed on the upper end 224 of the tube 222. The cap 230 is secured to the tube 222 by a ring 232 which is disposed about the tube 22 and a connector portion 234 extends between the ring 232 and the cap 234.

A web 240 is shown between the upper portion of the cylinder 202 and the tube 22 below the outer end 224. The web 240 simply helps to hold the tube 222 relative to the cylinder 202.

Above the web 240, there are convolutions or pleats 226 on the tube 222 which allow the outer end 224 to pivot or move relative to the cylinder 202 as desired by a user of the apparatus 200. Thus, in use, the cap 212 is removed, and a drinkable liquid is poured into the cylinder 202. The cap 212 is then replaced to seal the container apparatus 200. With the cap 230 on the upper or outer end 224 of the tube the liquid within the cylinder 202 is relatively sealed therein for carrying purposes. When a user of container apparatus 200 desires a drink, the cap 230 is removed, and the tube 222 acts as a straw through which the liquid is withdrawn from the bottom of the lower portion of the cylinder 202 through the opening 220.

FIG. 23 illustrates an alternate embodiment of the container apparatus 200 in which the portion of the tube or conduit 222 below the web 240 is configured as a handle 242. Thus, a user of the apparatus may hold the container by the handle portion 242 while drinking from the upper portion or outer end 224 of the conduit or tube 222.

FIG. 23 discloses still another alternate embodiment of the container apparatus 200 in which the outer end 224 of the tube 222 is inserted into a cylindrical boss 250 which extends outwardly from an elongated neck portion 207 of the container 200. The use of the cylindrical boss 250 obviates the need for the cap 230 and its associated elements. If desired, an aperture 252 may extend through the neck 207 at the boss 250 to define a vent for the container 202.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What we claim is:

1. Container apparatus comprising in combination:

container means for holding a quantity of liquid, including a container having a bottom and a top wall;

a boss extending upwardly from the top wall;

a breather spout on the boss;

a handle secured to the top wall and to the boss; and a conduit through which the liquid drains secured to the container adjacent to the bottom and disposed on the handle and the breather spout for storage.

2. The apparatus of claim 1 in which the container means further includes a fill spout on the top wall of the container and the boss is disposed adjacent to the fill spout.

3. The apparatus of claim 2 in which the container means further includes a slot on the handle for receiving a portion of the conduit.

4. The apparatus of claim 1 in which the conduit includes a bottom end secured to the container adjacent to the bottom and an outer end remote from the bottom end through which the liquid drains from the conduit.

5. The apparatus of claim 4 in which the means for securing the conduit to the container for storage includes a clamp for securing the outer end of the conduit to the breather spout.

6. The apparatus of claim 1 in which the container means further includes a discharge spout secured to the container adjacent to the bottom, and the conduit is secured to the discharge spout.

7. The apparatus of claim 6 in which the discharge spout includes a first bore through which the liquid flows from the container, an outer cap secured to the bore, a ball movable in the bore, a conduit portion on the ball, a second bore in the ball and conduit through which the liquid flows when the ball is moved to allow the second bore to be aligned with the first bore; and the conduit is secured to the conduit portion on the ball.

8. The apparatus of claim 7 in which the ball is movable between the drain position when the first and second bores are aligned and an off position when the first and second bores are not aligned to prevent liquid from draining from the container.

* * * * *